United States Patent [19]

Miner

[11] 4,285,601

[45] Aug. 25, 1981

[54] DRILLING MUD MIXER

[76] Inventor: Robert M. Miner, P.O. Box 373, Casper, Wyo. 82602

[21] Appl. No.: 87,049

[22] Filed: Oct. 22, 1979

[51] Int. Cl.[3] ..... B01F 5/10; B01F 15/02

[52] U.S. Cl. ..... 366/137; 137/577; 241/46 R; 366/165; 366/173; 366/174; 366/177

[58] Field of Search ..... 366/10, 27, 28, 34, 366/40, 134, 136, 137, 159, 165, 167, 173, 174, 177; 241/46 R, 46.02; 414/412; 137/577

[56] References Cited

U.S. PATENT DOCUMENTS

| | | | |
|---|---|---|---|
| 1,771,797 | 7/1930 | Lewis | 414/412 |
| 1,883,597 | 10/1932 | Cowles | 366/173 |
| 2,906,607 | 9/1959 | Jamison | 366/165 X |
| 2,969,225 | 1/1961 | Jenks | 366/165 X |
| 3,467,267 | 9/1969 | Van Elten | 414/412 |
| 4,170,420 | 10/1979 | Underwood | 366/165 X |

FOREIGN PATENT DOCUMENTS

| | | | |
|---|---|---|---|
| 1182625 | 12/1964 | Fed. Rep. of Germany | 137/577 |
| 1278999 | 10/1968 | Fed. Rep. of Germany | 366/165 |
| 2024765 | 1/1980 | United Kingdom | 414/412 |

*Primary Examiner*—Philip R. Coe

*Attorney, Agent, or Firm*—Laurence R. Brown

[57] ABSTRACT

A generally cylindrical mixing tank for oil well drilling mud circulates the mud passing out of a set of urethane nozzles about an elliptical path in the tank, which is coated internally with urethane thereby to provide a long lasting mixer in the presence of the abrasive drilling mud.

New ingredients are entered into the tank directly from bags as they are passed over a cutter knife and across an entry grillwork platform. Water may be added for proper viscosity.

The nozzles, by aid of a circulating pump taking mud from the tank, cause the mud to flow in a generally rotary path inside the tank and a set of knives is placed in this path to slice up any lumps or chunks of mud that may form.

8 Claims, 8 Drawing Figures

DRILLING MUD MIXER

TECHNICAL FIELD

This invention relates to accessory oil well drilling equipment and more particularly it relates to mixing of drilling muds.

BACKGROUND ART

In the drilling of wells it is customary to use drilling muds as exemplified by U.S. Pat. Nos. 3,243,000—J. T. Patton etal., March 29, 1966 and 3,275,551—M. R. Annis, Sept. 27, 1966. These patents show that special mud materials are important to the drilling process.

It has been known to mix drilling mud ingredients by adding the ingredients through a control valve into spray from jet nozzles in an on-line circulation loop in a pipeline returning mud taken from the well as shown in U.S. Pat. No. 2,423,801—J. I. Sloan, July 8, 1947.

Other drilling mud agitating techniques are shown in U.S. Pat. Nos. 4,149,603—J. F. Arnold, Apr. 17, 1979; 2,704,658—K. J. Gordon, Mar. 22, 1955; and 3,338,319—P. H. Griffin III, Aug. 29, 1967.

One problem unsolved by the prior art is that of mixer equipment deterioration from wear and corrosion in the presence of abrasive and chemically active mud ingredients which quickly rust, corrode and wear the mixer parts.

Another unresolved problem is the tendency of the mud to lump and cake and the difficulty in attaining a consistent desired mud viscosity.

Still another unresolved problem is the simple and rapid feeding of new special ingredients into the mud mixing apparatus.

A further unresolved problem is to provide high volume, high speed mixing of drilling mud to a desired viscosity.

It is therefore an object of this invention to provide improved drilling mud mixing equipment resolving the foregoing prior art deficiencies.

BRIEF DISCLOSURE OF THE INVENTION

Therefore in accordance with this invention drilling mud is mixed in a tank, coated internally with urethane, through which drilling mud is circulated for mixing to proper viscosity by means of discharge through urethane lined nozzles into the tank to produce a rotary flow path thereinside.

Internal cutting blades break up chunks of mud during the rotary circulation action effected by the flow from the nozzles which are fed from an external circulating pump. Water may be added to control viscosity and new mud ingredients are conveniently inserted directly from bags by passing over a bag opening platform where contents are dumped through a grill into the mixing tank.

Mud of proper constituency can be pumped from the pumping circuit or taken from an overflow pipe outlet from the tank as the materials are circulated by the pump to maintain the desired mud viscosity.

A stand is provided for positioning the mixer tank assembly at any convenient place near the well to receive the drilling mud.

Other features, advantages and objectives of the invention will be found throughout the following more detailed description of the invention and by reference to the accompanying drawing.

DETAILED DESCRIPTION OF A PREFERRED EMBODIMENT

Figure 1:
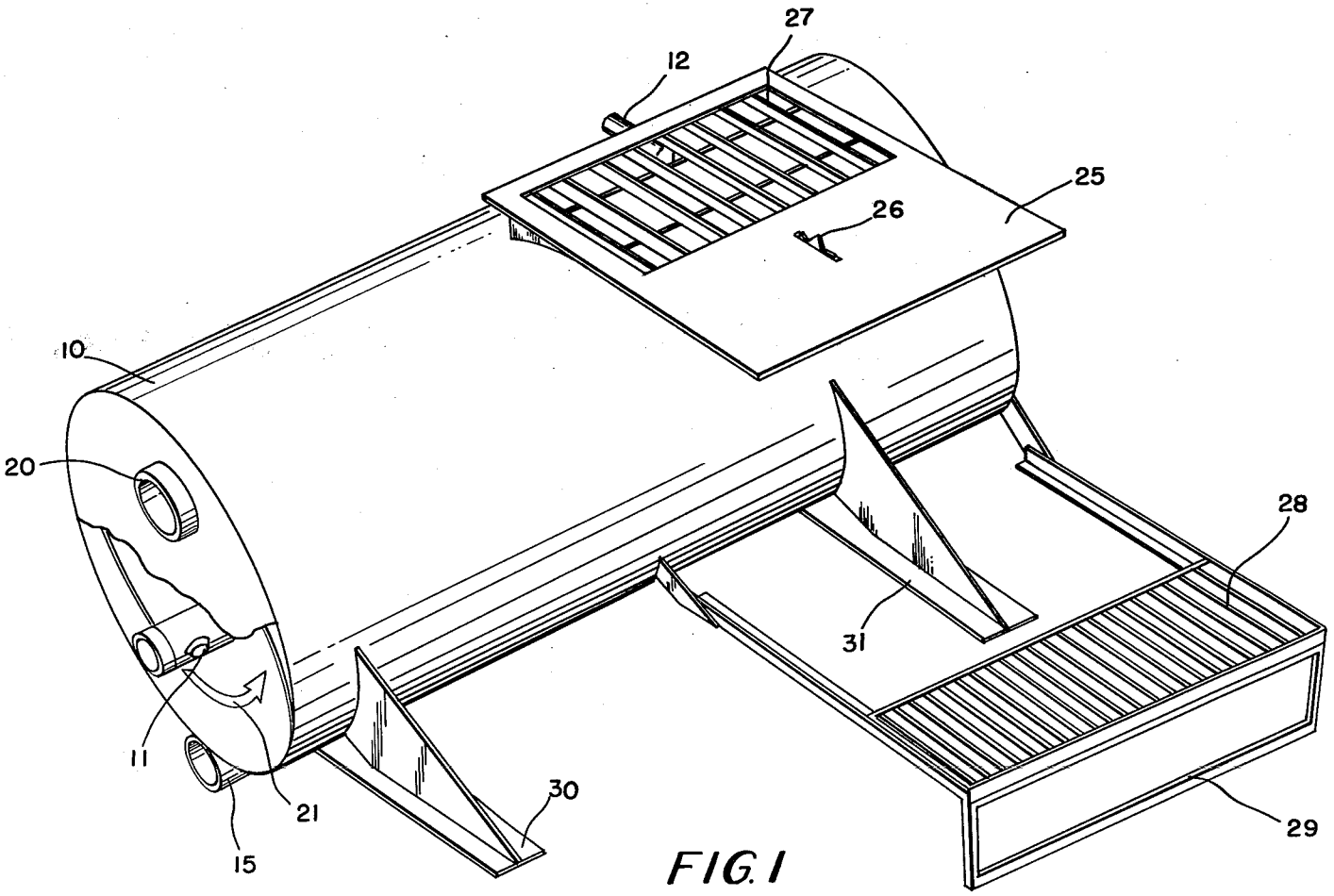
FIG. 1 is a perspective view, partly broken away of the mixing tank assembly provided by this invention.
Figure 2:
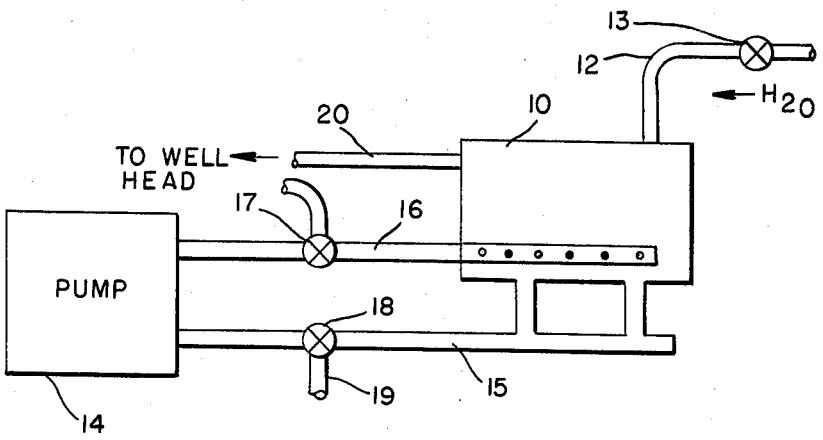
FIG. 2 is a schematic system diagram of the mud mixing system afforded by this invention.

As may be seen from FIGS. 1 and 2, a cylindrical tank 10 with an internal nozzle spray assembly 11 can take in water at 12 as controlled by a suitable valve 13. A pump 14 external to the tank can take mud from the tank 10 through pipe 15 and circulate it back through the nozzles by means of pipe 16, or as controlled by valve 17 can pump the mud into an adjacent well head. Similarly valve 18 will permit entry of mud from a well head into the pump via pipe 19 for circulation to enter new materials or to control its viscosity. A tank overflow pipe 20 is provided and material exiting the overflow pipe may also be sent to a well head, if desired. The nozzles 11 cause the mud inside tank 10 to rotate about the circumference of the tank as indicated by arrow 21.

New ingredients for the mud in bags are introduced at platform 25 and slid across knife 26 so that they fall through grating 27 inside the tank 10. A stepping platfrom 28 is provided for ease in manual entry of the bags of materials. This also provides a stand member 29 along with stand feet 30, 31 so that the mixing tank assembly can be located on site near a well head.

Figure 3:
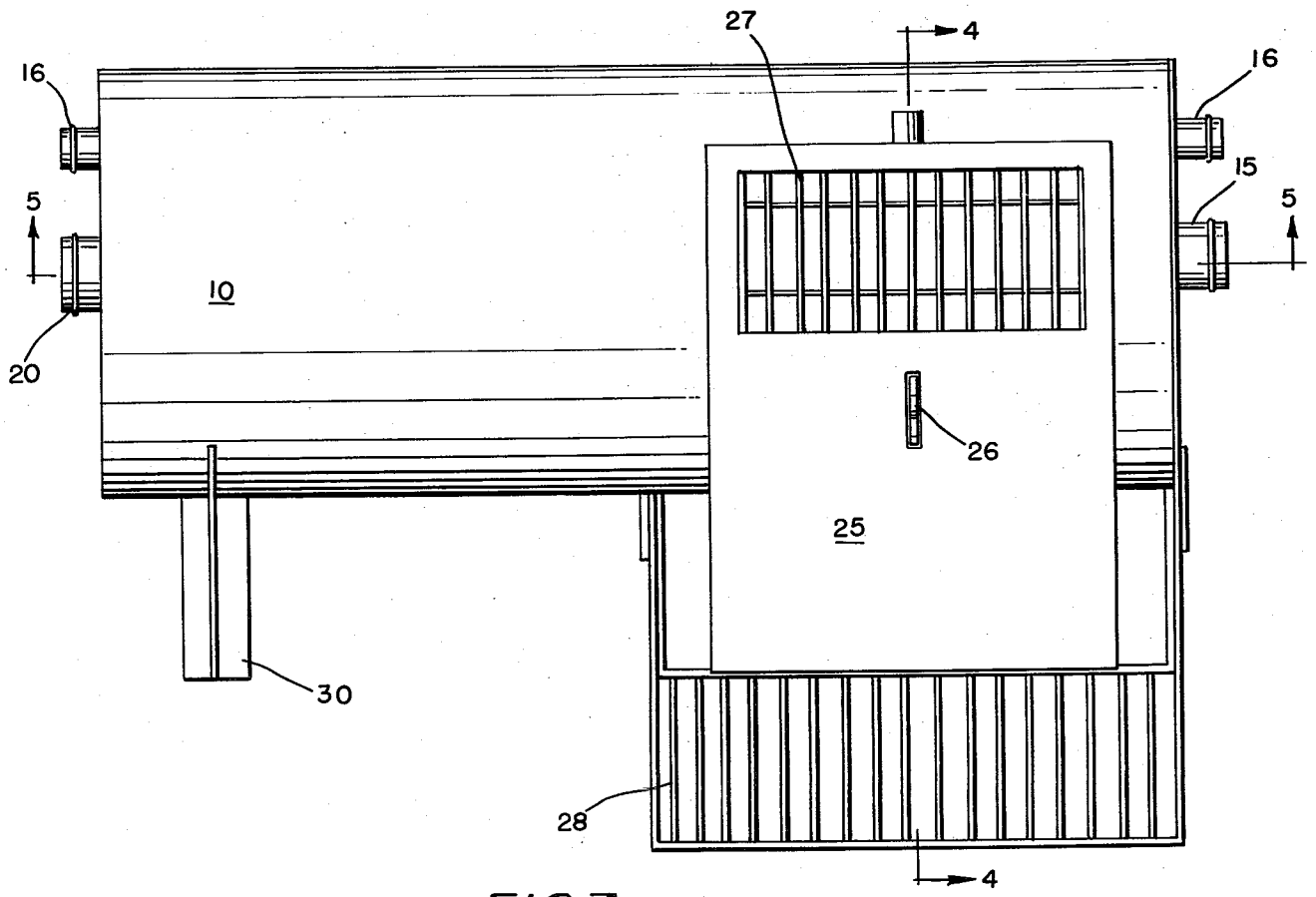
FIG. 3 is a plan view of the mud mixing tank.
Figure 4:
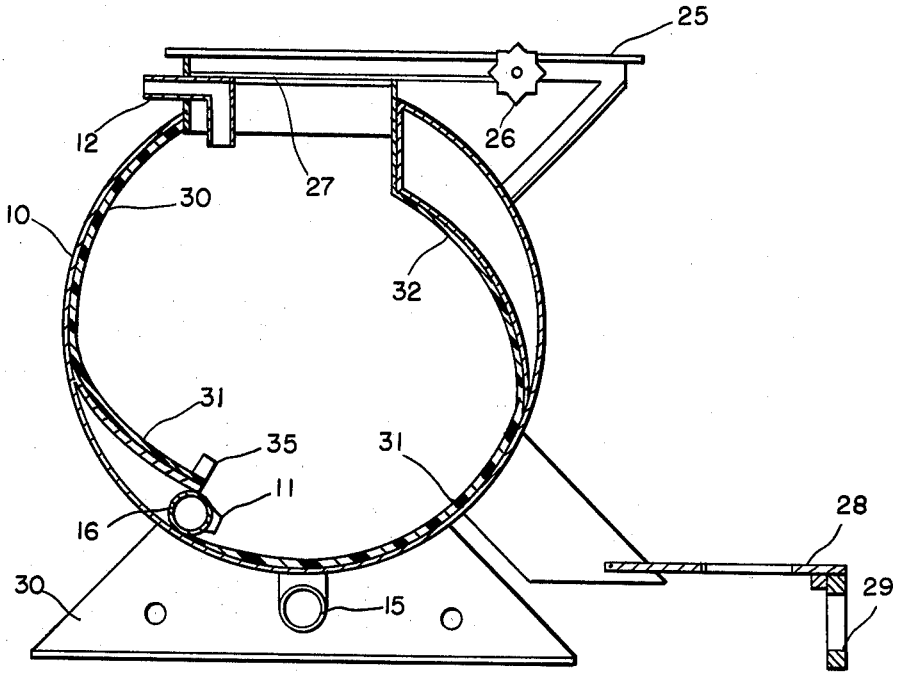
FIG. 4 is a section view of the tank taken along lines 4—4 of FIG. 3.
Figure 5:
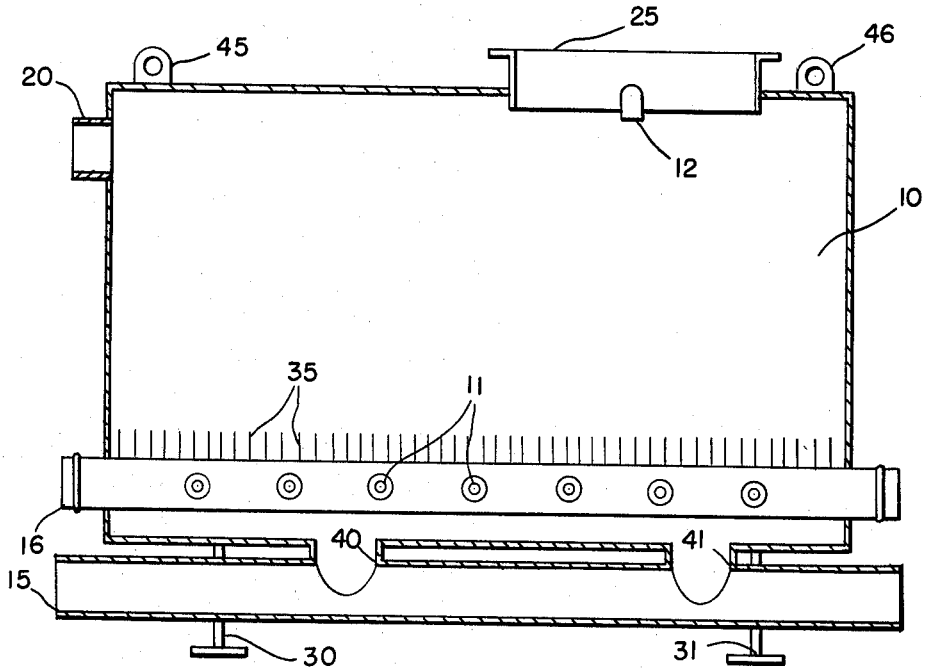
FIG. 5 is a section view of the tank taken along lines 5—5 of FIG. 3.

The construction details of the mixer tank assembly can be seen from the views of FIGS. 3, 4 and 5. To give some perspective of size, the tank 10 is 36 inches (91.5 cm) in diameter and 60 inches (152.5 cm) long.

The internal construction features are seen best from FIG. 4. Note that all interior surfaces have a coating 30 of one-quarter inch (0.63 cm) thick 80A durameter urethane. This provides long life in the presence of the circulating abrasive mud inside the tank. Deflector members 31, 32 modify the internal circular flow path to a generally elliptical pattern which produces better mixing of the mud and permits entry of ingredients through the grate 27. Also this prevents accumulation at pipe 16 and effects proper circulation by operation of nozzles 11. A set of cutter blades 35 as best seen from FIG. 5 serves to cut up chunks of mud as they circulate about the peripheral circumference of the tank 10 wall.

It is seen that mud is taken from the bottom of the tank at pipe outlets 40, 41 into the discharge pipe 15. The pipes extend from either end of the tank for coupling in series or for capping the pipes and the ends are preferably grooved for "Victaulic" type connections. At the top of the tank 10 for positioning by crane lift equipment are two eyelets 45, 46.

Figure 6:
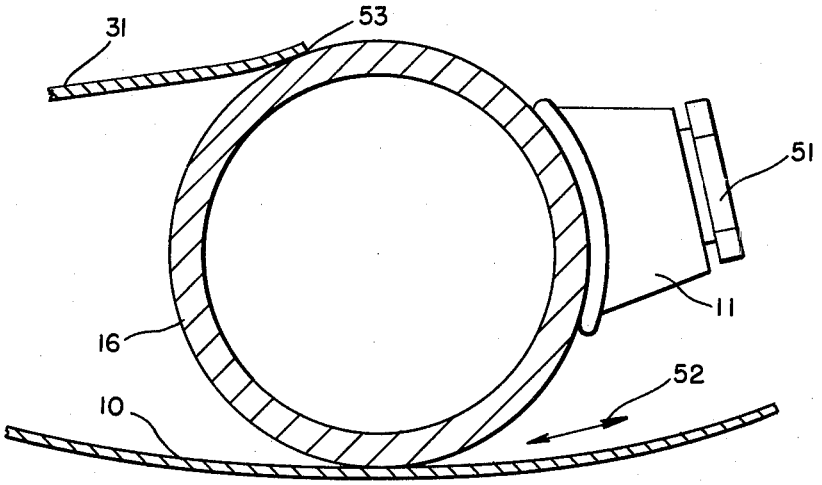
FIG. 6 is a fragmentary view of the nozzle assembly.

The view of FIG. 6 shows the nozzle tank intersection region in section detail before coating with urethane. The screw in nozzle assembly 51 is urethane. Silicone sealing material closes the intersections between the nozzle pipe 16 and the deflector 31 and tank wall.

Figure 8:
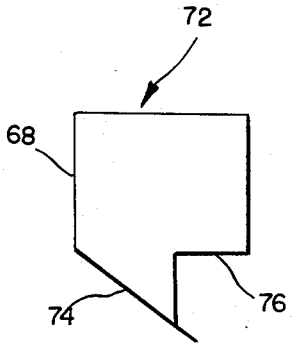
FIGS. 7 and 8 are assembled and side views respectively of a mud removal scoop afforded by this invention.
Figure 7:
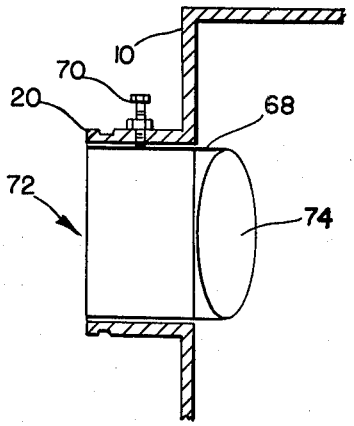

The views of FIGS. 7 and 8 show an adjustable scoop 68 that may be put into the overflow discharge pipe 20 and held in place by bolt 70. The scoop 68 is made of a piece of piping fitting within the inner diameter of the overflow discharge pipe 20. It has an open end 72 and a closure panel 74 disposed at an angle to the axis of the closure cylinder, with the piping notched out at the innermost extremity of the panel 74 about a portion of the cylinder 76 and open to form a scoop for entry of the mixed mud and chemicals as they circulate into the scoop opening when they are above a desired level, thereby to flow from notch 76 out opening 72. The scoop 68 may be rotated or longitudinally positioned for controlling the extent of removal of the mud.

Having therefore shown an improved mud-mixing assembly, those novel features believed descriptive of the nature and spirit of the invention are defined with particularity in the claims.

INDUSTRIAL APPLICATION

A long life mixer tank prepares drilling mud for oil well drilling rigs at a proper viscosity and is on a stand positionable at the well head site. It is loaded with special mud ingredients in sacks which are cut open and entered into the mixer tank through a grillwork ledge.

I claim:

1. A mixer for preparing drilling mud at a desired viscosity, comprising in combination, a generally cylindrical tank, a set of nozzles located axially along the tank about the internal periphery disposed to direct materials in a rotary flow pathway about the interior circumference of the tank, path deflector means shaping the internal tank periphery to direct the rotary flow path into an elliptical orbit substantially symmetrical about the tank axis, material input means for introducing drilling mud ingredients into the tank for mixing into the rotary flow pathway before encountering the nozzles, means for introducing liquids into the tank to effect a change of drilling mud viscosity, and means for removing drilling mud from a position near the internal periphery of said tank to circulate back through said nozzles.

2. A mixer as defined in claim 1 wherein the interior surfaces of said tank encountering the flow path are covered with a coating of urethane.

3. A mixer as defined in claim 1 including a set of cutting blades disposed in said tank to intercept drilling mud in the rotary flow pathway for slicing up lumps and chunks of mud.

4. A mixer as defined in claim 1 wherein said nozzles present a urethane surface to the flow of mud therethrough.

5. A mixer as defined in claim 1 wherein the shaping means for altering the rotary flow pattern of mud within said tank comprises diametrically opposed deflector members respectively shielding said nozzles and the material input means from direct encounter with the rotary flow path.

6. A mixer as defined in claim 5 having an input flow pipe for said nozzles comprising a pipe axially disposed within said tank along the circumference thereof with said nozzles removably mounted along the input flow pipe.

7. A mixer as defined in claim 1 having an overflow orifice, containing a scoop assembly in an upper portion of the tank, for directing a portion of materials flowing in said rotary flow pathway out of the tank when the tank becomes overfilled.

8. A mixer as defined in claim 7 wherein the scoop comprises a substantially cylindrical pipe, positionable lengthwise and rotatably within the overflow orifice, having an external open mouth and an internally disposed closure plate disposed at an angle to the axis of the cylindrical pipe with a notch opening permitting entry of materials about a portion of the cylinder adjacent the innermost end of said closure plate.

* * * * *